US009121108B2

(12) United States Patent
Duerig et al.

(10) Patent No.: US 9,121,108 B2
(45) Date of Patent: Sep. 1, 2015

(54) METHODS AND APPARATUSES FOR POSITIONING NANO-OBJECTS WITH ASPECT RATIOS

(71) Applicant: International Business Machines Corporation, Armonk, NY (US)

(72) Inventors: Urs T Duerig, Rueschlikon (CH); Felix Holzner, Langnau am Albis (CH); Armin W Knoll, Adliswil (CH); Walter H Riess, Thalwil (CH)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 207 days.

(21) Appl. No.: 13/871,148

(22) Filed: Apr. 26, 2013

(65) Prior Publication Data

US 2013/0284598 A1 Oct. 31, 2013

(30) Foreign Application Priority Data

Apr. 30, 2012 (GB) ..... 1207463.9

(51) Int. Cl.
*C25D 13/04* (2006.01)
*C25D 13/02* (2006.01)
*C25D 13/22* (2006.01)

(52) U.S. Cl.
CPC ..... *C25D 13/04* (2013.01); *C25D 13/02* (2013.01); *C25D 13/22* (2013.01)

(58) Field of Classification Search
CPC ..... C25D 13/04; C25D 13/02; C25D 13/22; Y10S 977/84; Y10S 977/762
See application file for complete search history.

(56) References Cited

U.S. PATENT DOCUMENTS 7,522,512 B1 4/2009 Cannara et al.
2006/0092370 A1 5/2006 Lu (Continued)

FOREIGN PATENT DOCUMENTS

CN 102020241 A 4/2011
EP 1803683 A1 7/2007

(Continued)

OTHER PUBLICATIONS

Holzner, Felix et al., "Directed Placement of Gold Nanorods Using a Removable Template for Guided Assembly," Nano Letters 2011, 11, 3957-3962, Aug. 19, 2011.
Hochrein, Marion et al., "DNA Localization and Stretching on Periodically Microstructured Lipid Membranes," Physical Review Letters (PRL) 96, 038103, 1-4, Jan. 25, 2006.

*Primary Examiner* — Jennifer Dieterle
(74) *Attorney, Agent, or Firm* — Vazken Alexanian

(57) ABSTRACT

A method for positioning nano-objects on a surface and an apparatus for implementing the method. The method includes: providing a first surface and a second surface in a position facing each other, where one or more of the surfaces exhibits one or more position structures having dimensions on the nanoscale; providing an ionic liquid suspension of the nano-objects between the two surfaces, where the suspension comprises two electrical double layers each formed at an interface with a respective one of the two surfaces, and the surfaces have electrical charges of the same sign; enabling the nano-objects in the suspension to position according to a potential energy resulting from the electrical charge of the two surfaces; and depositing one or more of the nano-objects on the first surface according to the positioning structures by shifting the minima of the potential energy towards the first surface.

21 Claims, 7 Drawing Sheets

(56) References Cited

U.S. PATENT DOCUMENTS

| | | | | |
|---|---|---|---|---|
| 2007/0237706 | A1 | 10/2007 | Black et al. | |
| 2008/0233323 | A1 | 9/2008 | Cheng et al. | |
| 2010/0316960 | A1 | 12/2010 | Duerig et al. | |
| 2010/0319962 | A1 | 12/2010 | Clevenger et al. | |
| 2010/0326836 | A1* | 12/2010 | Sandhu | 205/109 |
| 2011/0278539 | A1 | 11/2011 | Bangsaruntip et al. | |
| 2012/0082944 | A1 | 4/2012 | Coady et al. | |
| 2013/0153425 | A1* | 6/2013 | Puleo et al. | 204/627 |
| 2014/0339090 | A1* | 11/2014 | Huang et al. | 204/603 |
| 2014/0363641 | A1* | 12/2014 | Lobez Comeras | 428/206 |

FOREIGN PATENT DOCUMENTS

| | | | |
|---|---|---|---|
| FR | 2930901 | A1 | 11/2009 |
| KR | 2010 0025836 | A | 3/2010 |
| WO | WO 01/84238 | A1 | 11/2001 |
| WO | WO 2008/060455 | A2 | 5/2008 |
| WO | WO 2010/108957 | A1 | 9/2010 |

* cited by examiner

METHODS AND APPARATUSES FOR POSITIONING NANO-OBJECTS WITH ASPECT RATIOS

CROSS-REFERENCE TO RELATED APPLICATION

This application claims priority under 35 U.S.C. §119 from GB Patent Application No. 1207463.9 filed Apr. 30, 2012, the entire contents of which are incorporated herein by reference.

BACKGROUND OF THE INVENTION

1. Field of the Invention

The invention relates to the field of methods and apparatuses for positioning nano-objects with aspect ratios.

2. Description of the Related Art

The controlled synthesis of nano-objects (i.e., nanoscale objects or nanoparticles, sized between 1 and 100 nanometers (nm)) in the form of spheres, rods or wires, etc., has led to a variety of applications in a host of scientific research areas. Bottom up synthesis leads to mono-crystalline nanoparticles and enables the fabrication of multi-component structures. Their structural properties often provide unique or superior performance of the particles in comparison to their top down-fabricated counterparts. A wide spectrum of applications, e.g. in integrated devices, are available if precise placement and alignment relative to neighboring particles or other functional structures on a substrate can be possible. Ideally, it is desirable to obtain both precise placement and alignment simultaneously at high packing density with placement accuracy on the order of the nanoparticle diameter, typically of 5-50 nm, so far, an unresolved challenge.

SUMMARY OF THE INVENTION

According to one aspect of the present invention, a method is provided for positioning nano-objects on a surface. The method includes: providing a first surface and a second surface in a position facing each other, where one or more of the surfaces exhibits one or more positioning structures having dimensions on the nanoscale; providing an ionic liquid suspension of the nano-objects between the two surfaces, where the suspension includes two electrical double layers each formed at an interface with a respective one of the two surfaces, and the surfaces have electrical charges of the same sign; enabling the nano-objects in the suspension to position according to a potential energy resulting from the electrical charge of the two surfaces; and depositing one or more of the nano-objects on the first surface according to the positioning structures by shifting the minima of the potential energy towards the first surface.

According to another aspect of the present invention, an apparatus is provided for implementing a method for positioning nano-objects on a surface. The apparatus includes: a first surface and a second surface, in a position facing each other, where one or more of the two surfaces has positioning structures with dimensions on the nanoscale; an ionic liquid suspension of nano-objects between the two surface, where the suspension includes two electrical double layers each formed at an interface with a respective one of the two surface, and the surfaces have electrical charges of the same sign; and a positioning means coupled to the first surface and/or the second surface, where the positioning means is configured to move the first surface relative to the second surface during operation.

DETAILED DESCRIPTION OF THE PREFERRED EMBODIMENTS

Figure 1:
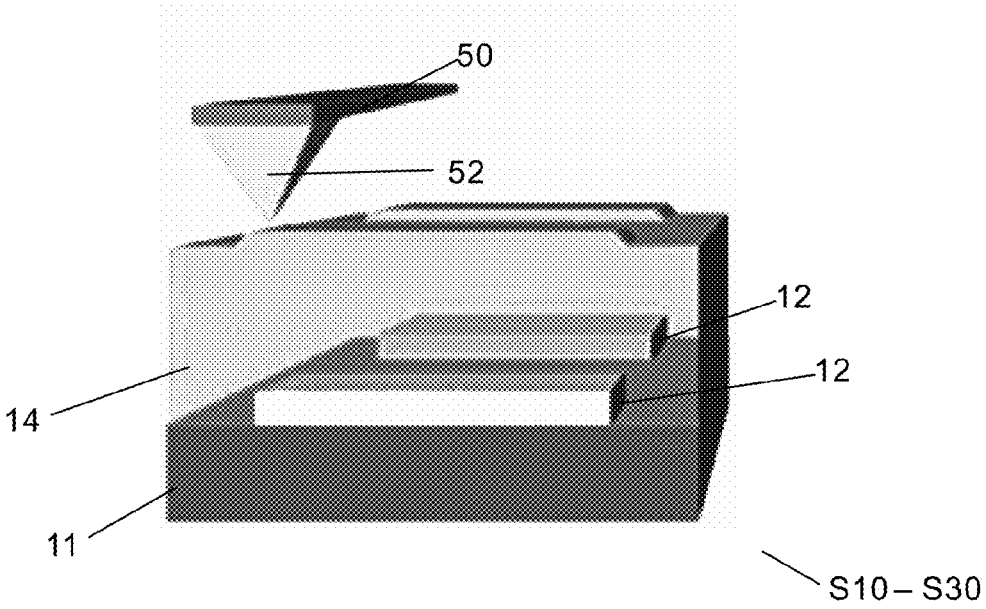
FIGS. 1-6 are schematic 3D views, illustrating steps of a method for positioning nano-objects, according to embodiments of the present invention.

The present invention provides a new methodology, which makes it possible to precisely orient and place charged nano-objects at desired positions on a target substrate of choice. Present methods rely only on the charge of the confining surfaces and the liquid, possibly the particles too, which allows for the placement of a wide range of particles ranging from micro-meter long nanowires, all the way down to DNA and proteins. Particles can be neutral or charged, dielectric or metal, etc. These methods advantageously apply in particular to high aspect ratio nanoparticles like nanowire, opening up a way to exploit the functionality of these complex bottom-up derived objects. They can be aligned to existing structures on the substrate enabling device integration. The method works in parallel and high throughput values can be achieved. In addition, the positioning steps can be repeated on top of already assembled items to build up complex three dimensional (3D) functional circuits.

According to a first aspect, the present invention is embodied as a method for positioning nano-objects, on a surface, the method includes: providing two surfaces including a first surface and a second surface in position facing each other, where at least one of the two surfaces exhibits one or more positioning structures having dimensions on the nanoscale; and providing a ionic liquid suspension of the nano-objects between the two surfaces, the suspension including two electrical double layers formed, each, at an interface with a respective one of the two surfaces, the electrical surface charges of the two surfaces being of a same sign; enabling nano-objects in the suspension position according to a potential energy resulting from the electrical charge of the two surfaces; and depositing one or more of the nano-objects on the first surface according to the positioning structures, by shifting minima of the potential energy towards the first surface.

In embodiments, depositing includes reducing a distance between the surfaces, so that the minima of the potential energy are shifted towards the first surface. The distance is preferably reduced to less than 200 nm, more preferably less than 100 nm.

The two surfaces provided are designed to have an asymmetrical electrical charge, so that each of the two surfaces exhibits a same electrical charge sign and the second surface has a higher electrical charge than the first surface.

Nano-objects provided have an aspect ratio, preferably higher than 2:1, more preferably higher than 5:1; the positioning structures provided include one or more grooves extending parallel to an average plane of the first surface or an average plane of the second surface; and enabling nano-objects position according to the potential energy further includes letting the nano-objects orient according to the potential energy.

According to embodiments, the first surface provided is the surface of a layer of a removable material provided on a substrate and preferably including a polymer such as polyphthalaldehyde.

The method further includes, prior to providing the two surfaces, creating the positioning structures in the layer of the removable material, preferably by a thermal scanning probe lithography technique.

In embodiments, the method further includes, after depositing the nano-objects, removing the removable material to transfer one or more nano-objects deposited on the first surface to the substrate.

In embodiments, removing the removable material includes evaporating the removable material, where the removable material is preferably a polymer, the polymer being evaporated at a temperature above the ceiling temperature of the polymer.

The method further includes, after removing the removable material, providing a new layer of material on top of the deposited nano-objects and repeating the steps of: providing the two surfaces and the ionic liquid suspension; enabling nano-objects position; and depositing, where the two surfaces now includes a surface of the new layer of material as a new first surface.

In embodiments, the method further includes depositing the removable material onto the substrate, prior to providing the surfaces, and depositing the removable material preferably includes spin casting a polyphthalaldehyde film onto the substrate.

In variants, depositing the removable material includes depositing the removable material onto both the substrate and one or more pre-existing structures such as electrodes or pads on the substrate.

The method further includes dragging the suspension of nano-objects, for example a water-based suspension, into and/or from a gap between the two surfaces, the gap being preferably less than 200 nm, and dragging is preferably carried out by way of capillary and/or electrophoretic forces.

According to embodiments, depositing the nano-objects includes reducing a distance between the surfaces, so that the minima of the potential energy are shifted towards the first surface, and reducing the distance between the surfaces includes moving the first surface relatively to the second surface, perpendicularly to an average plane of one of the two surfaces, and where the second surface preferably includes one or more of the positioning structures.

The second surface provided is tilted with respect to the first surface and depositing the nano-objects includes reducing a distance between the surfaces, so that the minima of the potential energy are shifted towards the first surface, where reducing the distance includes moving the first surface relatively to the second surface, parallel to an average plane of the first surface.

According to another aspect, the invention is embodied as an apparatus, adapted for implementing the method according to any one of the above embodiments, the apparatus including: two surfaces in a position facing each other: a first surface and a second surface, where at least one of the two surfaces has positioning structures with dimensions on the nanoscale; a ionic liquid suspension of nano-objects between the two surfaces, the suspension including two electrical double layers formed, each, at an interface with a respective one of the two surfaces, the electrical surface charges of the two surfaces being of a same sign; and positioning means coupled to the first surface and/or the second surface, the positioning means configured to move the first surface relatively to the second surface, in operation.

Methods and apparatuses embodying the present invention will now be described, by way of non-limiting examples, and in reference to the accompanying drawings.

The following description is of general embodiments of the present invention and high level variants. Referring generally to FIGS. 1-7, and in particular to FIG. 3, an aspect of the invention is first described, which concerns methods for positioning nano-objects 20 on a surface, at desired positions and possibly with desired directions.

First, first surface 15 and second surface 17 are placed in position facing each other. At least one of the surfaces, for example surface 15, exhibits positioning structures 16. In variants, second surface 17 or both surfaces can be provided with such structures. Positioning structures 16 have dimensions on the nanoscale, i.e., at least one characteristic dimension thereof (e.g., a diameter or principal length) is between 1 and 100 nm.

Second, ionic liquid suspension 30 of the nano-objects is confined between surfaces 15 and 17. The ionic liquid, for example be a water-based suspension, is dragged into the gap between surfaces 15 and 17. The gap is preferably less than 200 nm. Dragging the liquid can be carried out by way of capillary and/or electrophoretic forces. In variants, one can squeeze a droplet of liquid between the two surfaces, etc.

The surfaces and the liquid are designed, such that the suspension includes two electrical double layers (or EDLs, also called double layer). Each of the EDLs is formed at an interface with a respective surface. Two EDL systems arise because of the two surface-liquid interfaces involved. EDLs are known and have been the subject of many research papers in the past decades. An EDL appears at the surface of an object (solid object or particle, or even a liquid droplet) when placed in contact with a liquid. A "double layer" refers to two parallel layers of charges next to the object surface. The first layer refers to the surface charge (either positive or negative), that includes ions adsorbed directly onto the object due to a host of chemical interactions between the surface and the liquid. The second (diffuse) layer includes ions, which arise in reaction to the first layer. These ions electrically screen the first layer and are attracted to the surface charge via the coulomb force. Rather than being firmly anchored to the first layer, the second layer is diffuse (and is thus called the diffuse layer) and the free ions it includes move in the liquid under the influence of both the electric attractions and thermal motion. The second layer; therefore, refers to the liquid.

Thus, surfaces 15 and 17 each present a surface charge, i.e., the "first" layer of the respective EDL is charged. Each of the surfaces exhibits the same electrical charge sign. Preferably, the charge is asymmetric, i.e., second surface 17 has a higher electrical charge than first surface 15. As a result, the nano-objects in the suspension are stabilized by charge in suspension (or at least interact therewith, by way of entropic/electric effects) and thus, can also be "charged". Therefore, they do not deposit on either of the two surfaces. The potential energy, as experienced by a nano-object in the suspension, which results from the charge of the surfaces, typically exceeds the thermal energy of this object and thus, prevents it from depositing. Note that an uncharged particle disturbs the cloud of ions responsible for the built-up of the potential. Therefore, a dielectric particle also experiences a force due to entropic reasons. Consequently, present methods also work for dielectric particles.

The potential energy, as experienced by the particles, results from the charged surfaces and the reaction of the liquid (containing ions). This potential essentially controls the nano-objects. The concentration of ions determines the range of the potential, that is, how far it reaches into the liquid. The charge of the nano-objects can be refined by adding charged surfactants to the ionic solution, which will self-assemble around the particle and provide the charge. The nano-objects, i.e., particles, can also be chemically modified by attaching charged molecules covalently on the particles surface, i.e. thiols on gold or silanes on $SiO_x$ surfaces. The charge of such molecules can be modified by controlling the pH of the water solution, as can be the charge of the surfaces, etc.

Figure 3:
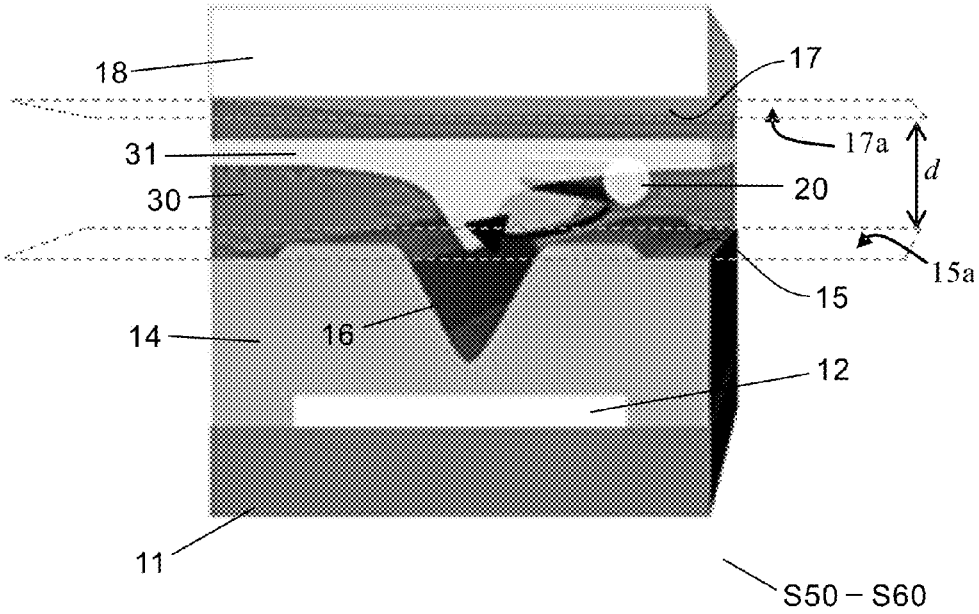
Figure 4:
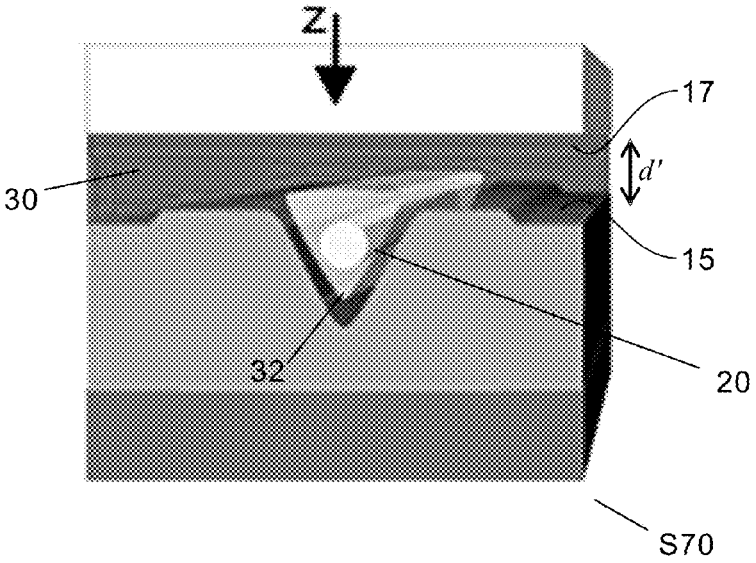

Nano-objects in the suspension will spontaneously position (and possible orient) according to the potential energy resulting from the electrical charge of the surfaces. This potential energy has a non-flat profile, whose shape is notably determined by the positioning structures. An estimated potential energy contour surface 31 is represented in FIGS. 3-4. Reference 32 denotes a minimum of the potential energy.

Finally, nano-objects can be deposited on first surface 15, according to the positioning structures, by shifting minima 32 of the potential energy towards first surface 15. Namely, a force field is applied which allows the nano-objects to overcome the electrostatic potential barriers imposed by first surface 15 (i.e., the lower charge surface). As a result, particles deposit on first surface 15, according to positioning structures 16. Particles adjust their position and orientation before and during deposition.

Referring to FIG. 4, in embodiments of the present invention, applying the force field is most practically realized by reducing a distance between the surfaces. As schematically depicted in FIGS. 3-4, distance d is accordingly reduced to a distance d', where d'<d. Reducing the distance allows the potential barrier to decrease the potential barrier, i.e., to shift potential minima 32 towards first surface 15. In addition to reducing the distance, the (asymmetrical) charges of the surface can be varied to shift potential minima 32.

A number of parameters will impact the potential experienced by the particles. The range of the potentials is determined by the ionic concentration in the solution. This range will also determine to which resolution the topographic features can determine the potential. If the range is large, small features in the topography will not be reflected in the potential. Therefore, if the range is short, the potential has higher resolution and will improve the precision of the placement process. The minimum range is given by the minimal achievable separation between the surfaces which ensures transfer of the particles. Therefore, the distance d is reduced to values as small as possible, e.g., below 200 nm. In some cases, this distance will need to be reduced to less than 100 nm, as exemplified later. At such separation distances, capillary and/or electrophoretic forces can be used to drag the liquid.

Preferably, present positioning methods are applied to nano-objects 20 having an aspect ratio. The positioning structures can be grooves 16 (or any elongated structures, or more generally structures reflecting the symmetry of the nano-objects), extending parallel to average plane 15*a* of surface 15. Thus, nano-objects having an aspect ratio will position and orient according to the potential energy, i.e., according to the grooves. As illustrated in FIG. 3-6 or 8-10, aspect ratios will typically be higher than 2:1. In fact, much higher aspect ratios can be contemplated, e.g., higher than 5:1 or even higher (nanowires). Referring to FIGS. 3 & 4, since high aspect ratio particles are deposited according to a groove-shaped potential, the higher the aspect ratio, the better, in principle, the obtained deviations. Thus, present methods are more advantageous when applied to such objects, at variance with known schemes. However, positioning structures other than grooves can be provided, e.g., in correspondence with the shape of the nano-objects. For example, the positioning structures can be simple indentations or, on the contrary, have more complex shapes than grooves (e.g., "L", "U" or "T-shaped", etc.). Even, they can be defined to trap two or more nanoparticles in a defined geometry.

Referring to FIG. 1, in embodiments of the present invention, first surface 15 is the surface of a layer of a removable material 14 that is provided on a substrate 11. The removable material is typically an organic resist, preferably a polymer, such as polyphthalaldehyde. Working with a removable material eases the upstream manufacture process and provides flexibility in the choice and dimensions of the structures, e.g., in a scanning probe lithography (or SPL) context. In addition, it makes it possible to transfer deposited objects to the substrate and provide additional "layers" of nano-objects, deposited on top of previously deposited objects.

Material 14 preferably includes polymer chains, which are able to unzip upon suitable stimulation (energetic or chemical modification event, protonation, etc.). There, film 14 can be stimulated via nano-probe 52 for triggering an unzipping reaction of polymer chains. The polymer material can include polymer chains, for which an energetic or chemical modification event triggers the unzipping reaction. Typically, stimulating a first chemical modification or degradation event triggers a partial or total unzipping effect. Thus, patterning steps need to include proper stimulation, typically by heating the layer of material 14 via probe 50, such that a suitable modification event occurs in a polymer chain of the polymer material. Probe 50, 52 should be designed, e.g., connected to an electrical circuit, to allow for heating of the probe during a controlled time and at a controlled temperature. As discussed above, the polymer material preferably includes poly-phthalaldehydes. An organocatalytic approach to the polymerization of phthalaldehyde is preferred, e.g., using dimeric 1-tert-butyl-2,2,4,4,4-pentakis(dimethylamino)-$2\Lambda^5$,$4\Lambda^5$-catenadi(phosphazene) ($P_2$-t-Bu) phosphazene base as an anionic catalysts in presence of an alcoholic initiator. For example, a resulting polymer (including ~200 monomer units equivalent to a molecular weight of 27 kDa) possesses a low ceiling temperature and facilitates the ability to create permanent patterns by selective thermolysis, using a heated probe. With such materials, deep patterns can be written with very little indentation force applied to the probe tip. This minimizes pattern distortion that results from indenting or displacing the material. Furthermore, polymeric chains can be made of an arbitrary length which offers substantial flexibility in tuning the material properties, such as the glass temperature and solvent resistance. An additional advantage is that no fine-tuning of intermolecular forces is required at variance with materials requiring stabilization from a secondary structure, such as hydrogen bonds.

In variants, material 14 can include a polymer material where molecules are cross-linked via intermolecular bonds. Such molecules can conveniently desorb when patterning the polymer material with heated nano-probe 50, 52. An average molecular mass of the molecules is preferably between 100 Da and 2000 Da, and more preferably in the range from 150 Da to 1000 Da, which offers enhanced desorbing properties. The film can be cross-linked via intermolecular bonds, such as van der Waals forces or Hydrogen bonds. When probe 52, suitably heated, is urged against the surface of film 14, and interacts with it, the interaction is likely to desorb one or more molecules. The probe temperature and the exposure time of the probe to the surface can be suitably adjusted to optimize desorption of molecules.

Material 14 can be deposited onto the substrate using known methods, e.g., by spin casting the material, e.g., a polyphthalaldehyde film, onto the substrate.

Figure 2:
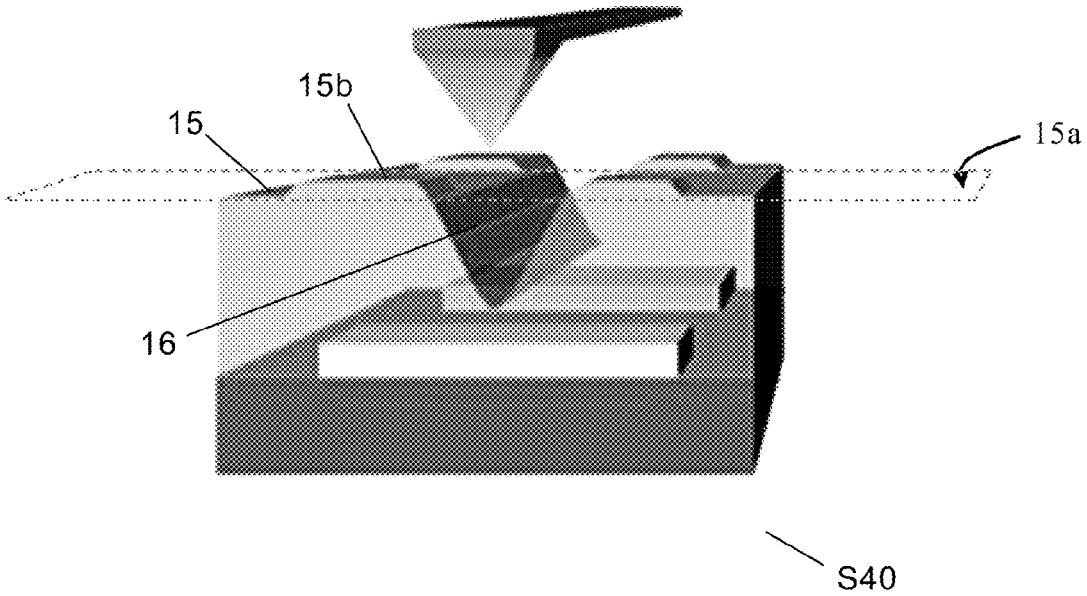

Referring to FIG. 2, using removable material 14 notably offers flexibility, e.g., for creating the positioning structures in layer 14, prior to the deposition of nano-objects. A preferred method to achieve this is thermal scanning probe lithography or tSPL, a high resolution patterning method that has been recently developed in the IBM Zurich Research Laboratory. This method makes use of heated tips to locally remove organic resists with high precision. Dense lines can, for example, be written at a pitch of 30 nm and complex three-dimensional relief structures can be precisely reproduced. The relief structures can be written in a single patterning step. For two dimensional patterns, tSPL enables 20 times faster patterning compared to usual methods. Thermal SPL methods can create the written structures directly, enabling immediate inspection after fabrication using the same tip in imaging mode. This results in turnaround times of minutes to create high resolution patterns, which can be used for subsequent steps. For example, the written structures can be used to orient and position gold nanorods with high precision (about 10 nm). The created profiles are limited only by the shape of the writing tip. For instance, grooves have been written featuring opening angles of 60 degrees and a sharp bottom edge corresponding to the radius of the writing tip of about 5 nm. For completeness, thirty fields each including seventy-two of these guiding structures have been written in half a working day; these were subsequently used for deposition experiments.

Figure 5:
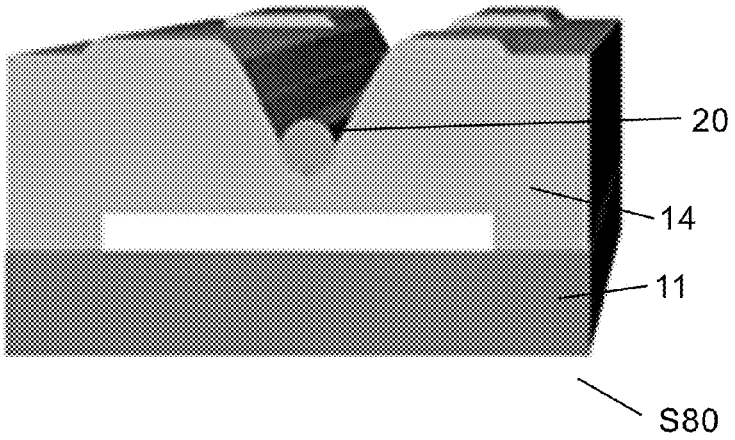
Figure 6:
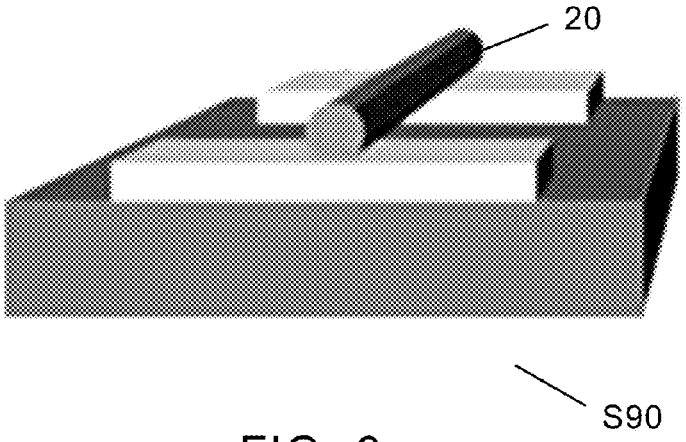

FIGS. 5-6 illustrate the final steps after deposition, where removable material 14 can be advantageously used to transfer nano-objects deposited on surface 15 to substrate 11. This way, nano-objects can be deposited to several types of substrates. Preferably, removable material 14 is evaporated. This material is typically a polymer that is evaporated at a temperature above the ceiling temperature, e.g., 150° C.

Once material 14 has been removed, i.e., once the objects have been transferred to substrate 11, a new layer of material (not necessarily the same removable material) can be provided on top of already deposited nano-objects, and the above steps repeat, in order to build complex architectures of nano-objects. This is illustrated in FIG. 7, which is a flowchart depicting steps of positioning methods according to embodiments.

Figure 7:
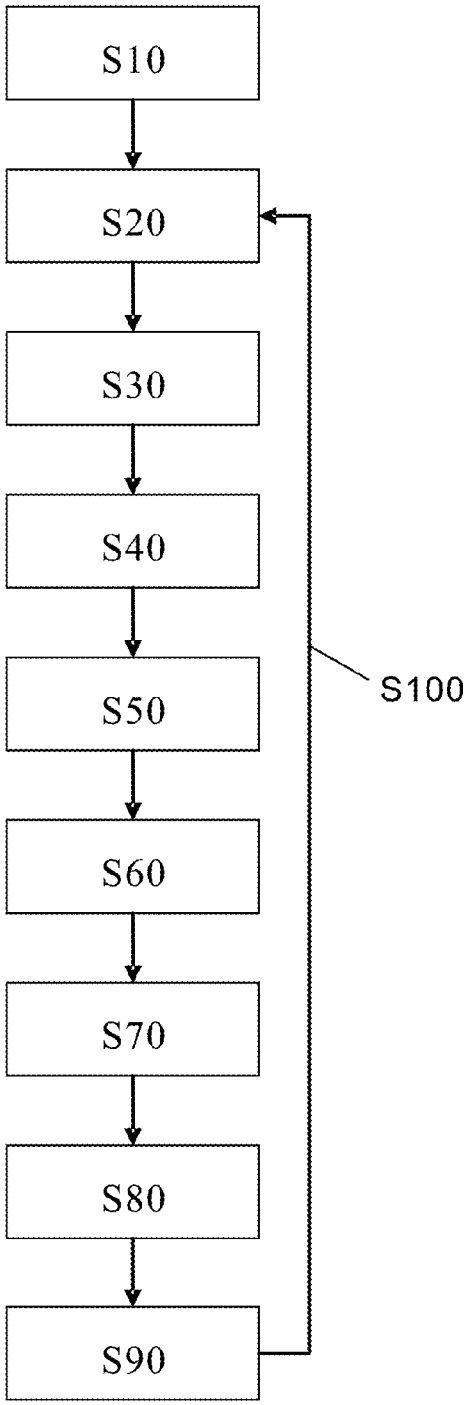
FIG. 7 is a flowchart showing the precise ordering of steps of a nano-object positioning method, according to embodiments of the present invention.
Figure 8:
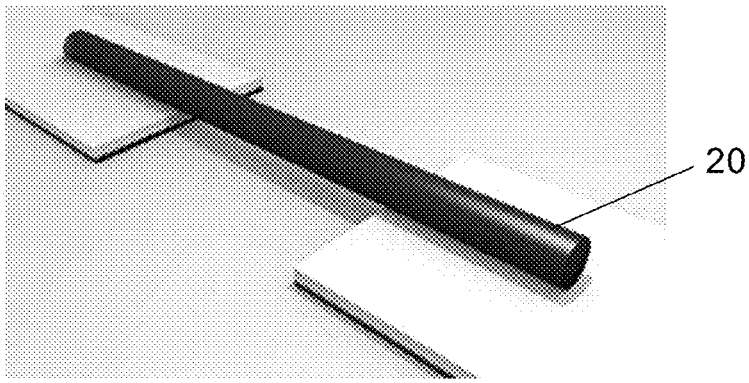
FIGS. 8-10 are schematic 3D views of examples of nano-object realizations, as obtainable in embodiments of the present invention.
Figure 9:
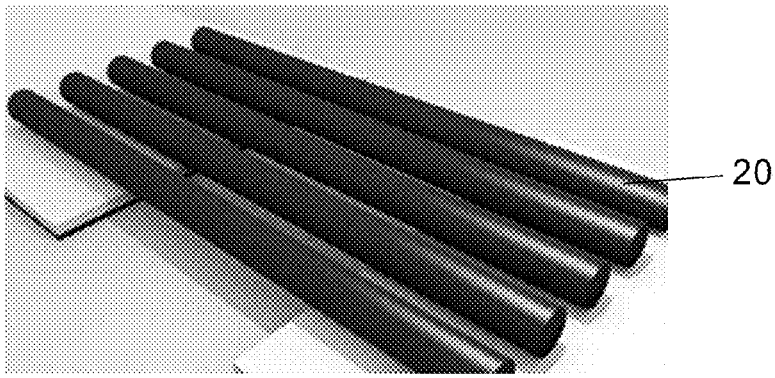

Referring to FIG. 7, steps can typically be carried out in the following order:

- S10: substrate 11 is provided (FIG. 1);
- S20: layers 12 and 14 are deposited on top of substrate 11 (FIG. 1);
- S30: desired locations of the positioning structures are ascertained, e.g., using accurate SPL positioning methods (FIG. 1);
- S40: positioning structures 16 are engraved on surface 15 at the desired locations, e.g., using tSPL (FIG. 2);
- S50: cover 18 is brought in proximity with surface 15 and the gap is filled with ionic liquid 30, e.g., using capillary/electrophoretic forces (FIG. 3);
- S60: an asymmetrical charge is applied to surfaces 15, 17 and nano-objects 20 self orient and position in the field (FIG. 3);
- S70: a force is applied, e.g., distance d between surfaces 15 and 17 is reduced, and nano-objects 20 deposit onto first surface 15 (FIG. 4);
- S80: ionic liquid 30 is removed after deposition (FIG. 5). Note that liquid can be dragged using the same method as before, during and after deposition. Residual liquid can be suitably rinsed and dried, if necessary;
- S90: layer 14 is removed (e.g., evaporated) to transfer particles 20 towards the substrate 11; and
- S100: the process can loop back to step S20. Namely, a new layer of material can be provided on top of already deposited nano-objects 20. Then, one can repeat one or more of the above steps S30-S90. Thus, new surfaces are placed in position facing each other and an ionic liquid suspension is confined in-between. Again, after applying an appropriate electrical charge, nano-objects will self orient and position in the field (S60) and finally deposit (S70) onto new surface 15, i.e., the surface of the new layer of material. The latter can be subsequently removed (S90), etc.

Figure 13:
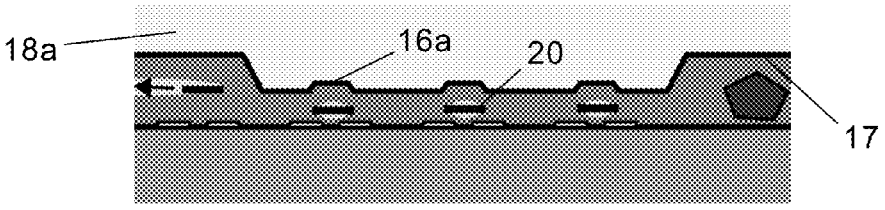
FIGS. 13 and 14 are schematic 3D views illustrating steps as involved in variants to the method for FIGS. 1-6.

So far, positioning structures have been essentially contemplated on receiving surface 15. However, variants are possible, as illustrated in FIG. 13. In this case, second surface 17 includes positioning structures 16*a*. In all cases, such positioning structures are advantageously provided as grooves, i.e., elongated slots dug in the thickness of cover 18 and/or layer 14, such as to define suitable minima contours of the electrical potential. In this respect, the repulsion energy occurring between charged objects 20 and each of surfaces 15 and 17, varies inversely proportionally to the distance, times an exponential damping factor (screened Coulomb potential). In variations, positioning structures 16*a* can be given more complex shapes, e.g., U, L, T, etc.

As further illustrated in FIG. 13, reducing the separation distance between the surfaces is most simply achieved by moving surface 15 relatively to surface 17, perpendicularly to an average plane 15*a*, 17*a*, e.g., by applying a force perpendicular to the first and/or second surface.

Figure 14:
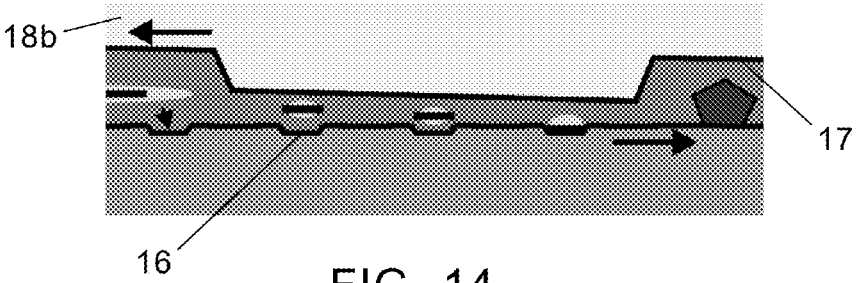

FIG. 14 illustrates another variation, where surface 17 is tilted with respect to surface 15. The separation distance between surfaces 15 and 17 can be achieved by moving surfaces 15 and 17 relative to each other, but parallel to the average plane 15*a* of surface 15. As seen in FIG. 14, the distance at a given position at surface is linearly decreased due to the relative motion of surfaces 15 and 17. This can be implemented in a roll to roll setup. No perpendicular actuation, in this case, is necessary and it has a number of advantages and applications that will be developed later.

Figure 11:
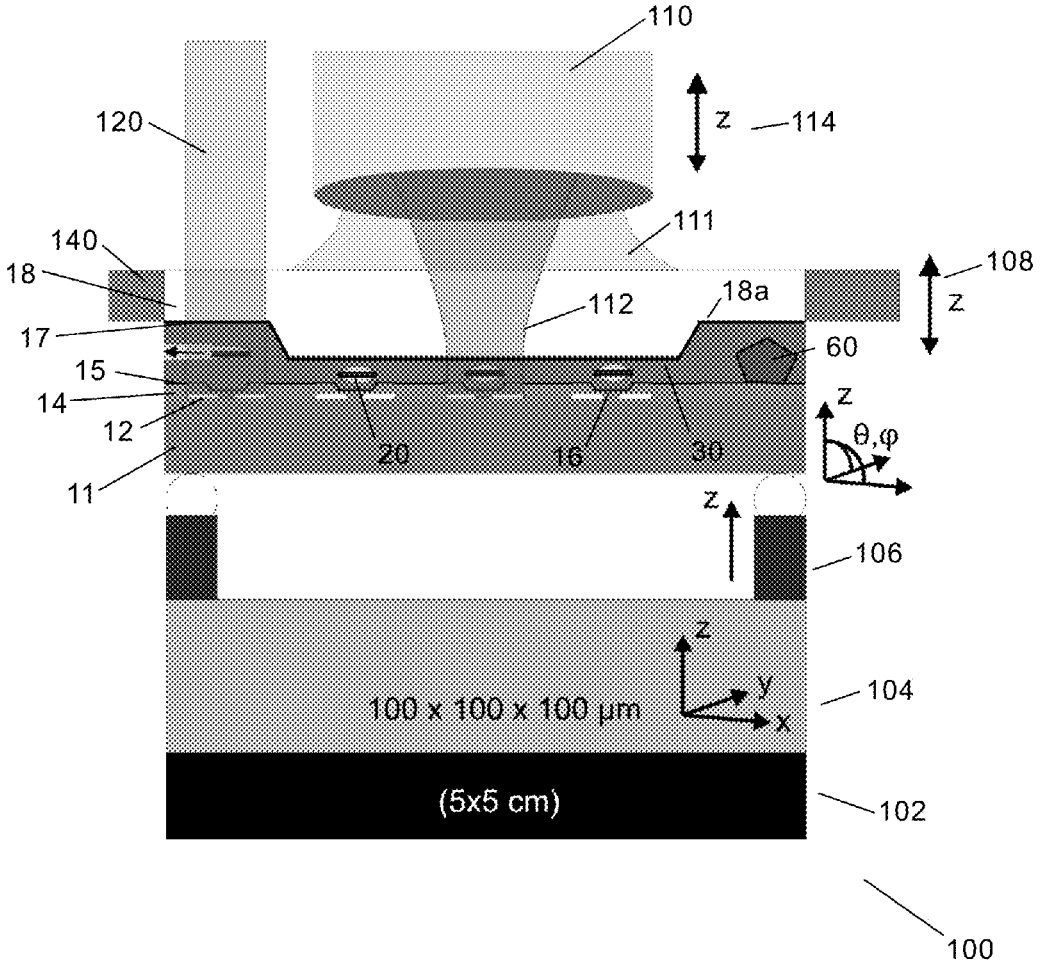
FIG. 11 is an example of an apparatus suitable for implementing methods, according to embodiments of the present invention.

FIG. 11 is an example of an apparatus suitable for implementing embodiments of the present methods. Consistent with the features of the methods recited above, this apparatus 100 at least includes:

- two surfaces 15 and 17 in a position facing each other, where at least one of these surfaces has positioning structures 16. Such surfaces are associated to respective "first layers", as described earlier;
- an ionic liquid suspension 30 of nano-objects 20 is confined or dragged between the two surfaces; and
- various positioning means 102-108, coupled to surface 15 and/or surface 17, i.e., to move the first surface relative to the second surface, while in operation.

Surfaces are charged naturally in response to the contact with a liquid. Additional chemical means can be involved, e.g., dissociating groups on the surface. If necessary, these surface charges can even be supported by an external electric field. Thus, an electrical control means can optionally be provided. The additional electric field can support the asymmetry of the charged surfaces. Fields on the order of delta V/d are typically needed, i.e. on the order of ~0.1 V/100 nm. Electrical control means can notably be used to help moving potential energy minima towards the receiving surface.

More generally, apparatus 100 can further include any feature in respect of the methods as contemplated in an embodiment of the present invention and described herein.

The above embodiments have been described in reference to the accompanying drawings. In preferred embodiments, several combinations of the above features can be contemplated. A detailed example is given below.

The specific embodiment of the present invention discussed in this section is especially suited for placement of high aspect ratio nano-objects. Capillary-based assembly does not work for such particles because the high densities at the three-phase contact line lead to the formation of close packed configurations, which hinder an aligned positioning. Therefore, it is preferred to use trapping forces as discussed in the previous sections to trap and pre-align the nano-objects in preferred directions, which are determined by the positioning structures. From these trapped states, the particles are then approached towards the target surface and finally brought into adhesive contact by approaching the confining surfaces.

The process flow of this placement strategy is depicted in FIGS. 1-6. The positioning structures are written into a thin film 14 (~90 nm) of polyphthalaldehyde (PPA), yet typically thicker than the buried structures 12. For the assembly process, the surface of cover-slip 18 is approached to less than 200 nm distance to PPA surface 15. Capillary and/or electrophoretic forces are used to drag a water based suspension of the nano-wires into the remaining gap. The particles are aligned and trapped in formed potential minima 32 (FIG. 3). External force-fields are then applied to shift minima 32 towards receiving surface 15 until adhesive contact is established (FIG. 4). Steps illustrated in FIGS. 3 and 4 are perhaps the most critical steps and are discussed more extensively below. After drying and rinsing the substrate (FIG. 5), the polymer is evaporated (sublimed) at temperatures above 150° C., i.e., the ceiling temperature of the polymer (FIG. 6). As has been verified experimentally, such a process preserves the ideal lateral position of the nanoparticles within instrumentation resolution limits (~2-3 nm). As a result, highly elongated nano-objects can be placed relative to pre-existing structures 16 on substrate surface 15.

The steps outlined above can be repeated to deposit a second layer of nano-objects on top of the first layer with similar accuracy in position and orientation. In this way, an assembly of different types of particles can be achieved and the functionality of each particle type can be exploited.

As discussed in more details below, a mechanical setup can be constructed, which allows the cover slip to align parallel to the substrate underneath, and to approach with nanometer precision. The setup is preferably designed for high quality optical access and the trapping performance can be studied in-situ. This setup can then be used to study the complex interplay between surface topography, curvature, and charging with the confined nano-particle suspension. The confinement can be varied in-situ due to the movable cover slip and the confinement effects can be studied without varying other parameters.

In summary, embodiments disclosed herein use geometrical confinement in combination with top-down designed topographical features to manipulate the local electrostatic potential in low ionic-strength solutions. A local electrostatic minimum is created which traps and aligns the nano-objects. In a second step, the objects are forced into adhesive contact by approaching the confining surfaces. The position and orientation is further focused by the shape matching topographical features on the receiving substrate. The placement process relies only on the charge of the nanoparticles and the confining surfaces. Any type of charged object can be used, ranging from high aspect ratio nanowires over flexible polymers (like DNA), down to potentially even single proteins. The placement can be precisely registered to underlying functional structures. Several placement steps can be repeated with similar accuracy. In particular, placing high aspect ratio nanowires according to methods described herein leads to a wide range of scientific and economic high impact applications, some of which are discussed below.

The methods discussed above have the following unique features in comparison to conventional placement methods.

First, the placement process is separated into a trapping step and a transfer step. This has several consequences. Elongated or more complex shaped objects can first adapt their planar orientation according to the trapping potential before they are transferred to the substrate surface. The forces acting on the objects are well defined by the shape of the electrostatic potential and the transfer method. This allows for placing fragile pre-assembled objects in a defined state. The separated steps allow for spectroscopically assessing the properties of the captured particle. Depending on the observed properties, decisions can be made as to whether the particle should be positioned or disposed.

Second, use is made of a decomposable polymer as a receiving material and a scanning probe based method to design the guiding topography. The polymer allows for decoupling the placement process from the underlying substrate and the writing method enables registration to underlying features. Combining both aspects, multiple subsequent placement steps can be achieved with precise registry. These unique features can be exploited for a number of applications. Two examples of applications are discussed below.

A first application concerns the positioning of several semiconducting or metallic nanowires on top of two pre-structured pads 12, as illustrated in FIGS. 1-6 or FIG. 8. One can establish a measurement of the electrical characteristics of a single nanowire 20 placed according to embodiments of the present methods. Another implementation is to place nanowires 20 in parallel and in high density across two predefined electrodes or pads (see FIG. 9). Such an assembly goes beyond FinFETs currently suggested for the 14 nm node in CMOS electronics. In fact, it can be realized that the performance of (top-down fabricated) nanowire field effect transistors is superior to state of the art CMOS technology due to the better electrostatic coupling of a wrapped around gate compared to a planar gate. Both implementations demonstrate the accuracy of the placement relative to pre-structured features on the substrate. In addition, improved placement densities are achievable thanks to the present positioning methods. In some (if not most) applications, the wires should be placed as dense as possible.

Figure 10:
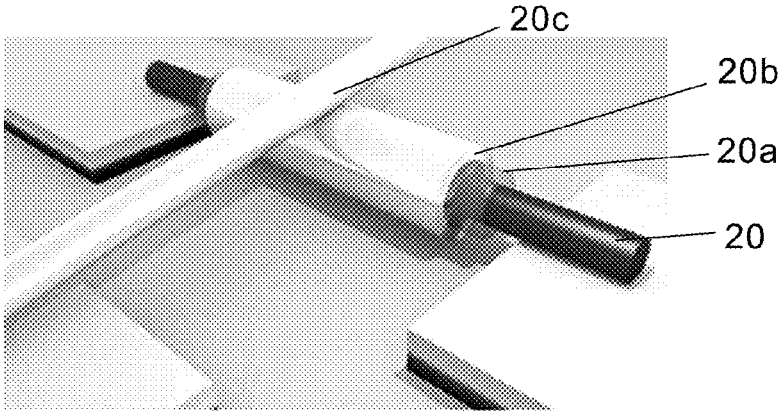

In a second application, functional nanowires grown by vapor-liquid-solid growth can be positioned to exploit the functionality of the wires. Functionality can be integrated by controlling the dopant concentrations during growth or building hetero-structures to other materials along the nanowire direction or in the radial direction in the form of core-shell structures. The nanoscale dimension enables the combination of materials with much larger deviations in lattice constants than possible in planar geometry. This enables the production of field effect transistors, light emitting, or harvesting devices, etc., in single nanowires. For example, FIG. 10 depicts an axially structured nanowire 20 including a gate oxide 20*a* and a metal gate wrap 20*b*, positioned across two electrodes. In a second placement step, a metallic nanowire 20*c* is positioned to contact gate metal 20*b*.

In applications, wires of different internal functionality can be integrated into a working circuit which combines single functions to achieve greater functionality. As an example, one can integrate a field effect transistor nanowire to drive a light emitting diode nanowire. Thus, present positioning methods provide a new way to approach the fabrication of the so called 'nanoprocessor'.

FIG. 11 exemplifies a possible setup for implementing methods described above. A cover slip 18 is mounted on a holder between substrate 11 and an oil/water immersion 111 microscope objective 110. Substrate 11 is mounted on a 5 degrees of freedom positioning system realized by a 3-axis piezo-scanner 104 and three piezopositioners 106 mounting substrate 11 in a kinematic holder. The vertical coarse approach and parallel alignment of substrate 11 is done by piezo positioners 106 (30 nm resolution). Fine adjustments of the gap distance are done by piezo scanner 104 (100×100×100 μm). A coarse positioning system 108 can be used to orient cover-slip 18 to the patterned parts in substrate 11. Such positioning systems can be obtained using components adapted from SPM systems.

Cover slip 18 can be patterned by optical lithography including a center island of 200-500 μm diameters which is raised by 20-50 μm. The recess of the remaining area can be provided to avoid problems with dirt particles 60 preventing the two surfaces from achieving approach distances below 100 nm.

The setup can be characterized using interferometric distance measurements 120, which allows for testing the stability of the setup and the response to the pressures induced by filling with liquid and approaching the confining surfaces. This way, mechanical stability of <1 nm in vertical direction and approach distances below 50 nm can be contemplated. The position and motion of the particles will be detected optically. For gold nanoparticles, the plasmonic response can be exploited using dark field microscopy. For semiconducting, particles scattered light or fluorescence can be detected. The Brownian motion of the particles at these length scales requires exposure times of <1 ms. Optimally, the time resolution of the setup needs to be sufficient to track the motion of single particles. However, for determining the shape of the potentials from the particle positions, a statistical measurement of the positions is sufficient. Preferably, a microscope, including a high speed camera, can be used to enable high fidelity detection path.

In operation, positioning of the substrate is carried out using piezo-motor driven x-y coarse positioning system 102, fine positioning piezo stage 104, and three piezo positioners 106 to align the plane of the sample and cover slip 18. Cover slip 18 is mounted on the holder and can be manually moved in vertical direction 108. Cover slip 18 is etched outside the optical viewing window with recess 18*a* having a depth of 20-50 μm to accommodate dirt particles and imperfect flatness of the sample. Microscope 110 is used to determine the particle positions using fluorescence or light scattering detection. The orientation of cover slip 18 with respect to the substrate plane is measured using laser interferometer 120.

In variations, apparatuses (and methods) according to embodiments of the present invention can include any one, or several of the features recited in respect of the setup of FIG. 11.

An in-situ characterization of the surface and particle potentials developed in the fluidic slit can be useful to understand the observed phenomena. For instance, electrodes can be implemented into the setup to generate lateral electric fields. The zeta potential of the particles can be obtained using a commercial Zetasizer (Malvern Instruments). If the particle potentials are known, the potential of the confining surfaces can be extracted from the particle speed in eletrophoretic/osmotic flow measurements in confined (unstructured) nanoslits. First, the potential of the glass surfaces can be determined using two confining glass surfaces. Using this knowledge, the potential of the confining polymer surface can be determined in a system using a polymer and a glass surface.

Notably, two types of stabilization strategies for the particle solutions can be used. For instance, one can use nanoparticles stabilized by organic surfactants. Nanoparticle solutions of this type are readily available commercially (Nanopartz, US), stabilized e.g. by Cetyl trimethylammonium bromide (CTAB). Also, the surfactants provide a simple way to control the charge density at the polymer surface, because the formation of a mono/multi-layer at the surfaces is expected. This has been corroborated by some experimental results on the stability of CTAB stabilized Au nanorods. Unspecific adsorption on the polymer surface was not observed. The drawback of using organic stabilizers is that they can influence the functional performance after assembly and can; therefore, need to be removed. They can, e.g., induce contact problems, if organic matter remains between the assembled particles and electrodes on the surface. However, in first experiments with gold nanoparticles, this was not observed.

One can also use purely electrostatically stabilized particle solutions in order to avoid organic molecules. It has been shown that the conductivity is enhanced in close packed assemblies of such particles. Methods are known which allow for exchanging the organic stabilizers by ions and works for a wide range of particles.

Both stabilization methods can also be used for stabilizing nanowires in solution. The measured values can be used to feed the simulations described below. They also give initial values to estimate the depth of the trapping potentials and guide the strategy for placing the nanoparticles.

The trapping potential of the system can warrant investigation. One can, for example, rely on the unique patterning capabilities offered by tSPL methods to define topographical structures with high precision in three dimensions. In variants, one can use nano-imprint lithography methods to create such structures with high throughput. The trapping potentials can be determined by measuring the position of the nanoparticles in real space and time. This can be done optically using a high numerical aperture (NA) objective and detecting scattered light from the particles.

Another possible concern is the observation of a curvature induced trapping potential and how it interplays with the topographically induced electrostatic minimum. In a feedback loop with modeling results, the topography which induces the trapping potential and the charge densities can be jointly optimized. This makes it possible to find optimal conditions which provide a stable trapping, e.g., of nano-objects with high aspect ratios.

Theoretical modeling efforts and computer simulations can be carried out using the commercial package COMSOL, in order to understand the effects discussed herein. This allows for understanding the trapping mechanisms including the curvature induced trapping potentials. In addition, the effect of external fields on the trapping potentials can be investigated. Some recipes of how to use COMSOL for related applications are available in the literature. The underlying idea is to solve the nonlinear Poisson-Boltzmann in three dimensions using charge neutrality and constant charge boundary conditions at the interfaces.

In establishing technical implementation details of the transfer methods, the goal is to optimize the conditions in the fluidic slit in a way that trapped particles can be transferred into adhesive contact with the substrate by external manipulation. How to achieve this can benefit from (but does not depend on) the results obtained in the theoretical modeling and computer simulation work evoked in above. The forces acting between particles and a (planar) surface are given by the well known Derjaguin, Landau, Verwey, and Overbeek (DLVO) theory. The theory predicts that at very small separations the attractive van-der-Waals forces dominate the electrostatic repulsive force and a nano-object can therefore be pulled into contact. However, to approach such distances, the repulsive electrostatic interactions need be overcome. A successful implementation of such a transfer process was demonstrated in the past. For instance, a successful transfer of 80 nm gold nanoparticles was achieved using laser powers ranging from 350 μW to 10 mW, corresponding to (calculated) forces of up to 15 pN. A preferred way of achieving the transfer is to use purely electrostatic forces. This ensures that the trapping and placement steps are only dependent on the charge of the particles and no other physical property. As discussed earlier, an idea is to use asymmetric charge densities on receiving PPA surface 15 and cover slip surface 17. In that case, the potential minimum can be shifted toward the side with the lower potential value.

The electrostatic potential can be calculated analytically assuming constant surface potentials and a planar geometry. The resulting potential $\psi$ between a first surface positioned at d=0 having a surface potential of ⅓ $k_BT/e$ (using standard notations) and a second surface at $d_S$=2, 3, 5, and 10 $\kappa^{-1}$ ($\kappa^{-1}$ being the Debye length) having a surface potential of 1 $k_BT/e$ is plotted in, FIG. 12*a*, the upper panel. The four curves, thus, correspond to surface separations of 10, 5, 3, and 2 $\kappa^{-1}$. The lower panel, FIG. 12*b*, depicts the potential barrier $\Delta\psi$ as a function of approach distance $\kappa$ d.

Figure 12:
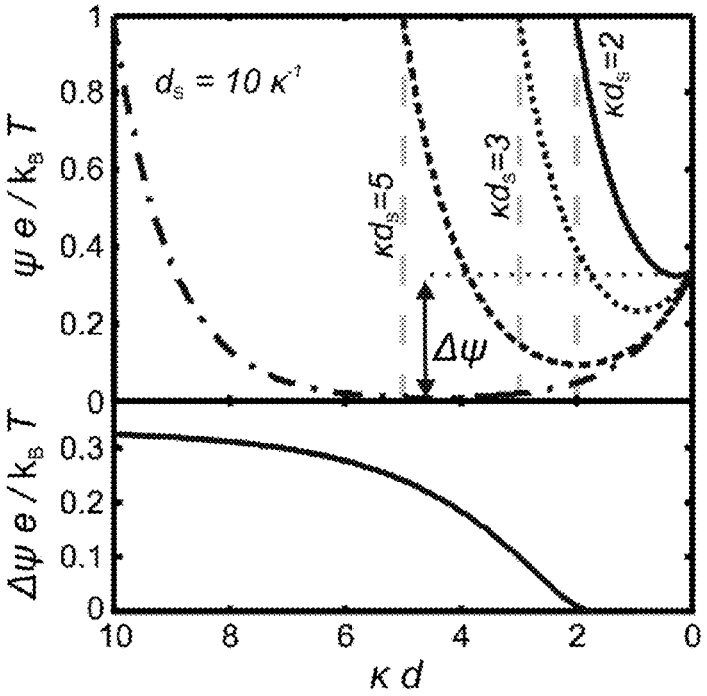
FIG. 12 shows two graphs illustrating: estimated electrostatic potentials between two asymmetrically charged surfaces (12*a*.) and a potential barrier as a function of the approach distance (12*b*.), as involved in embodiments of the present invention.

For large distances, the potential is sufficiently strong to trap certain types of particles. As the distance between the surfaces decreases, the potential barrier diminishes, as seen in FIG. 12*b*. Depending on the charge z of the particles this barrier has to be reduced to a few times $k_BT/(z\ e)$ for the thermal energy to overcome the barrier. With the parameters retained for the calculation of FIG. 12, the barrier vanishes at ~1.75 $\kappa^{-1}$. To translate these numbers into real-world dimensions, one needs to plug in values for the salt concentration. One can, for instance, use the parameters obtained in trapping experiments. The salt concentration for deep trapping potentials was found to be 0.07 mM (milli Molar), which leads to a Debye length of $\kappa^{-1}$=36 nm for monovalent ions. At these salt concentrations, the potential barrier is fully developed at a distance of d~5 $\kappa^{-1}$=180 nm (see FIG. 12). To successfully transfer the particles into adhesive contact, the surfaces have to be approached to a distance of ~72 nm. These calculations show that the conditions for transferring the particles are compatible with the conditions for a stable trapping of the particles. One can further adjust the charges on the cover slip by silanization. Potentials larger than 120 mV can be achieved and adjusted by the pH value. The exact charge on the polymer is unknown and possibly has to be determined, as discussed above. It can otherwise be estimated. In a first attempt, one can use the concentration of CTAB surfactants to adjust the surface charge on the polymer. The colloidal solutions used in the experiments carried out had a CTAB concentration of 0.1 mM. Using relatively high concentrations guarantee the stability of the solution at the three-phase contact line using the capillary assembly method. The solutions were examined to be stable to at least 0.01 mM concentration. As discussed above, accurate SPL-like positioning methods can be used.

As touched earlier, one can repeat the placement process onto nano-objects assembled in a previous placement step. A question is whether adhesive contact with the first layer is sufficiently stable to allow subsequent coating with PPA. An alternative method to coat the first layer of objects is to float a PPA film from a template surface. Depending on this step, subsequent steps can be carried out identically. If sufficient yield is achieved in the placement process, the stacking can be repeated several times.

A first application consists of positioning a metallic nanowire in a first step across two electrodes or pads, as depicted in FIGS. 1-6 and 8. Two additional contacts to this can then be established by placing two additional metallic wires crossing the first wire and attaching to two additional electrodes. Accordingly, one can establish a four point measurement using present placement methods. The contact resistance of crossed wires can be studied and improved, if necessary. Insights collected can be used in the assembly of a functional circuit, discussed below.

Next, one could want to design a parallel placement and printing scheme to achieve high throughput placement of nano-objects; be it at the price of the placement accuracy. In an implementation, topographical features can be etched into the cover slip using existing dry etch methods. The following sequence can be achieved:

trapping, transfer into adhesive contact,
moving to a new printing position, and
refilling of the gap by electophoretic forces.

This allows for patterning large areas with repeated assemblies of particles. Alternatively, the topography inducing the trapping potentials can be fabricated into the cover-slip (see FIG. 13) or into a silicon master wafer (see FIG. 14).

In the embodiment of FIG. 13, the cover slip is patterned in order to topographically induce the trapping potentials. After deposition by decreasing the gap distance, the template can be placed at a different position. The gap is refilled with particles by increasing the distance and/or by using electrophoretic means. The placement can be repeated at a new position.

Concerning FIG. 14, direct assembly into a silicon master template can be achieved using a tilted cover slip. The particles in the master are printed in a subsequent step onto a receiving surface (not shown) and the master can be reused.

The guiding potentials can be similarly shaped and the transfer to the substrate can be achieved by similar means. Both approaches have in common that the topographic shapes used for trapping can be reused multiple times. In the first case (FIG. 13), the structures are only used to form the potential minimum. The particles are transferred onto the opposite surface, by way of the potential minima. In the second case (FIG. 14), the particles are assembled into the master stamp, and are then printed after drying onto a receiving surface in a printing step. Thus, the trapping and printing steps are either done sequentially, as discussed above, or by sliding a tilted cover slip across the surface, as indicated in FIG. 14. Using the tilted slip, a vertical motion is unnecessary since the gap reduces during the sliding motion. Accordingly, large areas can be patterned at potentially high throughput values.

As another example, one can pattern a functional circuit from stacked functional nanowires placed in a cross-type fashion and aligned to pre-patterned electrodes on the surface, as in FIG. 10. The circuit can implement different types of wires for different functionality, e.g. semiconductor wires including a built-in FET and metallic or silicided wires for electrical connections.

While the present invention has been described with reference to certain embodiments, it will be understood by those skilled in the art that various changes can be made and equivalents can be substituted without departing from the scope of the present invention. In addition, many modifications can be made to adapt a particular situation or material to the teachings of the present invention without departing from its scope. Therefore, it is intended that the present invention not be limited to the particular embodiments disclosed, but that the present invention will include all embodiments falling within the scope of the appended claims. In that respect, not all the components/steps depicted in the accompanying drawings need be involved, depending on the chosen embodiments. In addition, many other variants not explicitly discussed above can be contemplated. For example, other materials can be used, as well as other separation distances.

What is claimed is:

1. A method for positioning nano-objects on a surface, said method comprising the steps of:

providing a first surface and a second surface in a position facing each other, wherein at least one of said surfaces exhibits at least one positioning structures having dimensions on the nanoscale; and an ionic liquid suspension of said nano-objects between said two surfaces, wherein said suspension comprises two electrical double layers each formed at an interface with a respective one of said two surfaces and said surfaces have electrical charges of the same sign;

enabling said nano-objects in said suspension to position according to a potential energy resulting from said electrical charge of said two surfaces; and depositing at least one of said nano-objects on said first surface according to said positioning structures by shifting the minima of said potential energy towards said first surface.

2. The method of claim 1, wherein depositing said nano-objects reduces a distance between said surfaces, so that said minima of said potential energy shifts towards said first surface, and wherein said distance is reduced to less than 200 nanometers.

3. The method of claim 1, wherein said two surfaces provided have an asymmetrical electrical charge, so that each said surface exhibits the same electrical charge sign and said second surface has a higher electrical charge than said first surface.

4. The method of claim 1, wherein:

said nano-objects have an aspect ratio higher than 2:1;

said one or more positioning structures comprise at least one grooves extending parallel to an average plane of said first surface or an average plane of said second surface; and enabling said nano-objects to position according to said potential energy further comprises enabling said nano-objects to orient according to said potential energy.

5. The method of claim 1, wherein said first surface provided is a surface of a layer of a removable material provided on a substrate and comprises a polymer.

6. The method of claim 5, wherein said method further comprises a step of, prior to providing said surfaces, creating said positioning structures in said layer of the removable material.

7. The method of claim 5, wherein said method further comprises a step of, after depositing said nano-objects, removing said removable material to transfer at least one nano-objects deposited on said first surface to said substrate.

8. The method of claim 7, wherein said step of removing said removable material comprises evaporating said removable material, wherein said removable material is a polymer, and said polymer is evaporated at a temperature above the ceiling temperature of said polymer.

9. The method of claim 7, wherein said method further comprises a step of, after removing said removable material, providing a new layer of material on top of said deposited nano-objects and repeating the steps of:

providing said two surfaces and said ionic liquid suspension;

enabling nano-objects to position; and depositing, wherein said two surfaces now comprise a surface of said new layer of material as a new first surface.

10. The method of claim 5, wherein said method further comprises a step of, prior to providing said surfaces, depositing said removable material onto said substrate.

11. The method of claim 10, wherein depositing said removable material comprises depositing said removable material onto both said substrate and at least one pre-existing structures on said substrate.

12. The method of claim 1, wherein said method further comprises a step of dragging said suspension of nano-objects, into and/or from a gap between said two surfaces, wherein said gap is less than 200 nm.

13. The method of claim 1, wherein said depositing step comprises reducing a distance between said surfaces so that said minima of said potential energy shift toward said first surface, wherein reducing said distance comprises moving said first surface relative to said second surface, perpendicularly to an average plane of one of said two surfaces.

14. The method of claim 1, wherein said second surface is tilted with respect to said first surface and wherein said depositing step comprises reducing a distance between said surfaces so that said minima of said potential energy shift towards said first surface, wherein said reducing said distance comprises moving said first surface relative to said second surface, parallel to an average plane of said first surface.

15. An apparatus for implementing the method for positioning nano-objects on a surface, said apparatus comprising:

a first surface and a second surface, in a position facing each other, wherein at least one of said two surfaces has positioning structures with dimensions on the nanoscale;

an ionic liquid suspension of nano-objects between said two surfaces, wherein said suspension comprises two electrical double layers each formed at an interface with a respective one of said two surfaces and said surfaces having electrical charges of the same sign; and a positioning means coupled to said first surface and/or said second surface, wherein said positioning means is configured to move said first surface relative to said second surface during operation.

16. The method of claim 5, wherein said polymer is polyphthalaldehyde.

17. The method of claim 6, wherein said positioning structures in said layer of the removable material are created by a thermal scanning probe lithography technique.

18. The method of claim 10, wherein depositing said removable material comprises spin casting a polymer film onto said substrate.

19. The method of claim 11, wherein said one or more pre-existing structures are electrodes or pads.

20. The method of claim 12, wherein said dragging is carried out by way of capillary and/or electrophoretic forces.

21. The method of claim 13, wherein said second surface comprises said positioning structures.

* * * * *